United States Patent [19]

Henderson

[11] 4,191,000

[45] Mar. 4, 1980

[54] WOODEN I-BEAM

[75] Inventor: Larry R. Henderson, Portland, Oreg.

[73] Assignee: Timjoist, Inc., Tualatin, Oreg.

[21] Appl. No.: 881,599

[22] Filed: Feb. 27, 1978

[51] Int. Cl.[2] ..... E04C 3/12

[52] U.S. Cl. ..... 52/729; 52/730; 144/309 L

[58] Field of Search ..... 144/309 L, 315 R, 316; 29/155 R; 52/729, 730, 731

[56] References Cited

U.S. PATENT DOCUMENTS

| | | | |
|---|---|---|---|
| 1,377,891 | 5/1921 | Knight | 52/729 X |
| 3,490,188 | 1/1970 | Troutner | 52/644 |
| 3,960,637 | 6/1976 | Ostrow | 29/155 R X |

FOREIGN PATENT DOCUMENTS

| | | | |
|---|---|---|---|
| 437720 | 11/1967 | Switzerland | 52/729 |
| 978639 | 12/1964 | United Kingdom | 52/729 |

*Primary Examiner*—C. J. Husar
*Assistant Examiner*—Conrad Berman
*Attorney, Agent, or Firm*—Chernoff & Vilhauer

[57] ABSTRACT

A wooden I-beam suitable for use as a joist or a rafter, comprising solid wooden flange members of rectangular cross section joined to opposite sides of a plywood web member by an adhesively fastened joint. Large joint contact surface area, and a small amount of wood removal from flange members to form the joint, cooperate to create a strong joint without unnecessary weakening of the flange members, thus producing wooden I-beam members of consistently high strength.

5 Claims, 5 Drawing Figures

FIG. 1
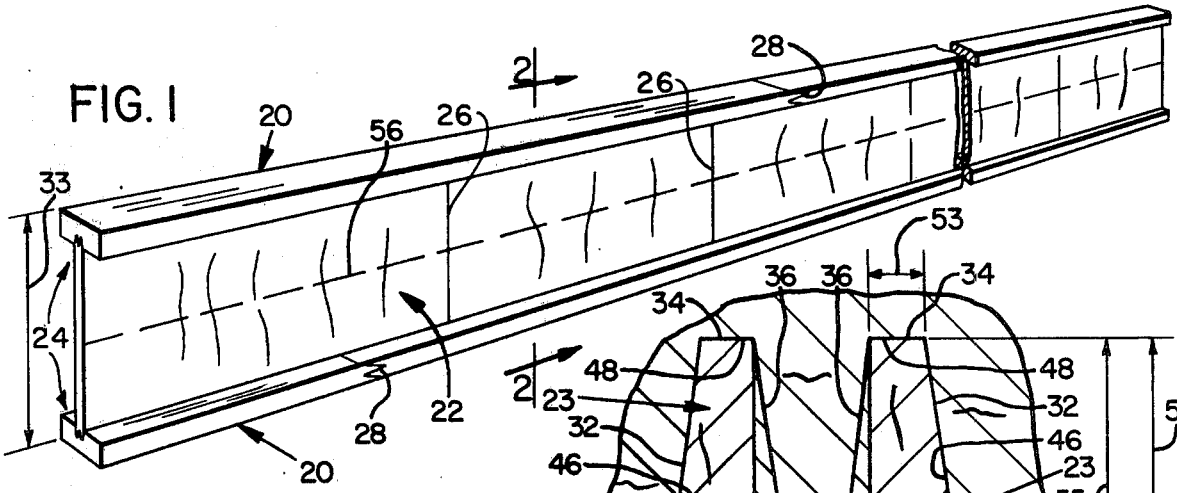
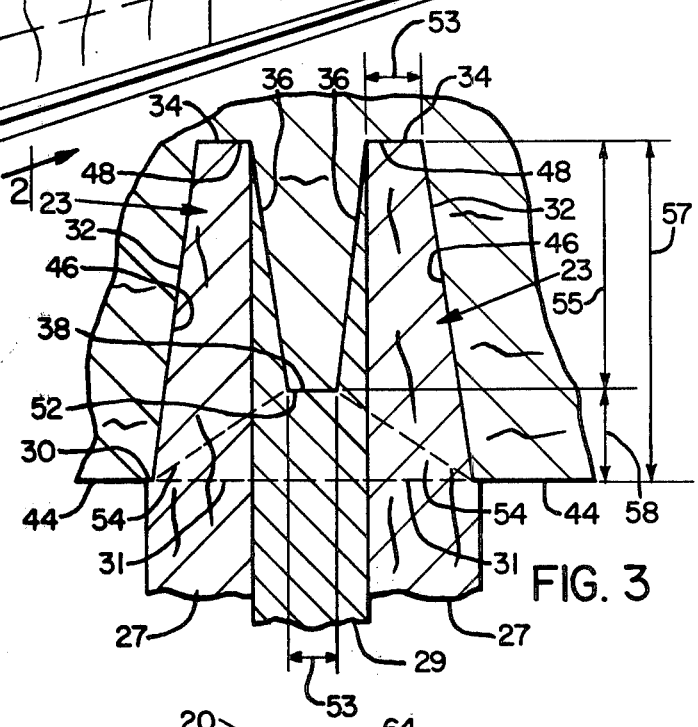
FIG. 3
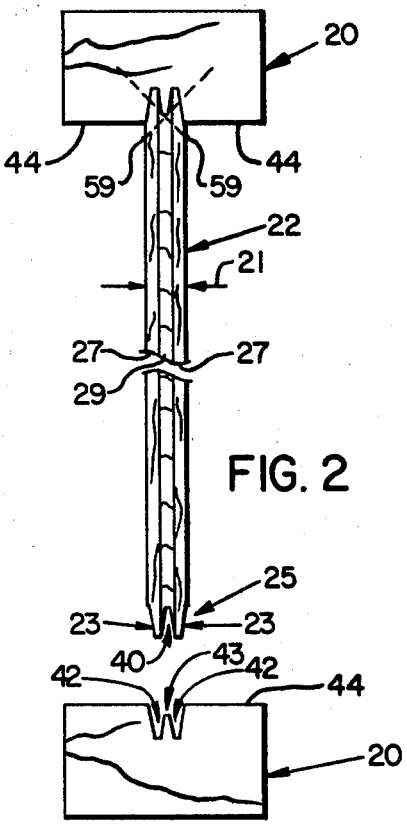
FIG. 2
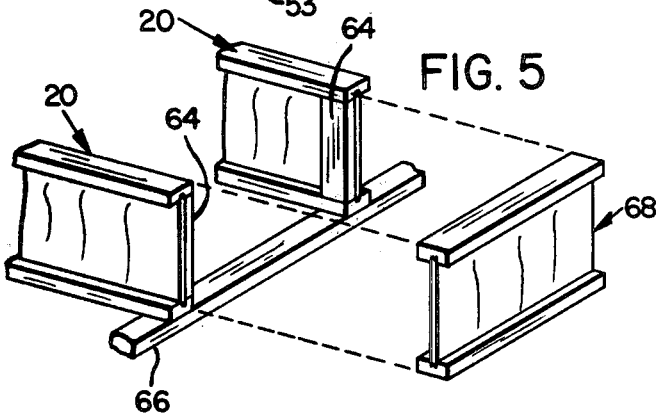
FIG. 5
FIG. 4
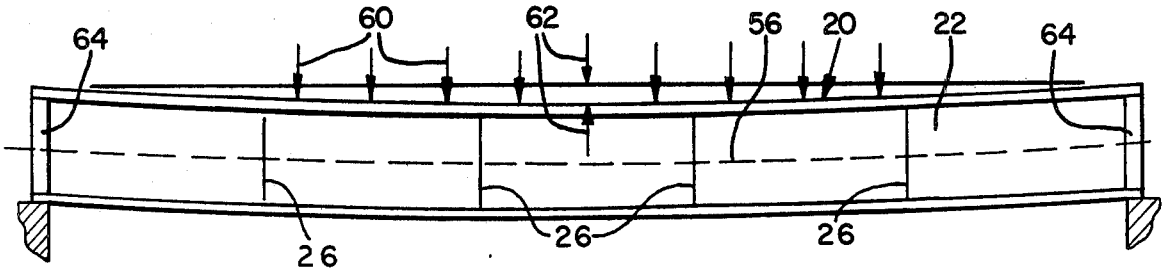

WOODEN I-BEAM

BACKGROUND OF THE INVENTION

This invention relates to wooden I-beams suitable for use as joists and rafters in construction of frame buildings, and particularly to wooden I-beams having solid lumber flanges and plywood webs.

Where strength is required to support loads applied primarily in one direction, considerable saving of weight and material cost may be accomplished by using a beam arranged in a form having a cross section resembling the capital letter "I" and called an I-beam. This general design provides required strength to support compressive and tension loads generated by application of a load to the top of such an I-beam resting on supporting structure, as when such a beam is used as a rafter or joist.

When a downward load is applied to the top of a beam so constructed, with the ends of the I-beam supported from below and the "I" cross section in an upright orientation, the stresses generated are distributed as compression along a top flange portion of the I-beam and tension in a bottom flange. The width of the top and bottom flanges gives required lateral stiffness, allowing the use of a narrow vertical web connecting the flanges. Thus for a given load supporting capacity, an I-beam is lighter than a solid beam having a rectangular cross section.

Although metal I-beams have long been used, within their strength range wooden I-beams are often superior. They cost less, are more easily cut to fit, and since they don't require special fasteners, are better adapted to wood frame construction such as houses and small office buildings.

Typically, to economically manufacture such beams having reliably consistent and uniform strength, clear, straight-grained lumber is used for the flange members, and the web is made from plywood and glued to both flanges.

Various adhesive-joint arrangements have been used in prior art wooden I-beams with some success, but with the disadvantage in some designs that assembly of the beam produces residual stresses in the composite beam member. In other designs, the sizable amount of wood cut from flange members, in the making of the joint, tends to weaken the flanges, reducing overall beam strength.

In one prior design, disclosed in Troutner U.S. Pat. No. 3,490,188, opposite margins of the web members are pressed to a tapered shape and adhesively fastened in a tapered groove in each flange. As the web absorbs adhesive, when it is inserted into the groove of the flange, the wood therein swells and thus the web tends to resume its original shape. The swelling causes a residual stress in the completed I-beam tending to split the flange.

Another prior means of connecting the web to the flanges of a wooden I-beam involves forcing a web member, having two thin parallel ribs on its edge, into divering grooves in the flange members, thus creating residual stresses tending to separate the laminations of the plywood web.

SUMMARY OF THE INVENTION

The present invention is directed to a novel means for attaching the flanges to the web in a wooden I-beam so as to overcome the disadvantages of prior art designs.

By using a joint of novel construction between the flange and web members, comprising two parallel tapered grooves in one face of each flange member and corresponding tapered ribs on mating edges of the plywood web member, the invention produces an I-beam assembly which has a minimum of included or residual stress in the flange-to-web joint, an increased surface area available for adhesive contact in the joint, and a reduced loss of cross section from the flange members in the fabrication of the joint.

Since the joint surfaces are matchingly cut into the flange and web members, instead of being pressed to shape as are the edges of the web members described by the prior art Troutner design, there is practically no residual stress in the joint caused by swelling of the edge of the web. Therefore, the I-beam construction of the invention is able to absorb greater amounts of lateral loading without failure of the flange along the web-to-flange joint, and results in beams of a consistently high strength.

It is therefore a principal objective of the present invention to provide a wooden I-beam which may be mass produced to have a consistently high strength.

It is another objective of the present invention to provide a wooden I-beam having a minimum amount of residual stress in the joints between flange members and web members.

It is a feature of the present invention that the joint between flange members and web members has a large amount of surface area, yet in its fabrication results in a minimal reduction in the flange member cross-sectional area.

It is a further feature of the present invention that the joint between the flanges and the web member, because of its inherent strength and integrity, is not the critical load-limiting portion of the I-beam.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a partially cut-away perspective view of an embodiment of the wooden I-beam member of the present invention.

FIG. 2 is a partially cut-away sectional view of the I-beam taken at line 2—2 of FIG. 1.

FIG. 3 is a detail of the joint construction between web and flange members of the I-beam.

FIG. 4 is a diagrammatic view of the I-beam in use.

FIG. 5 is a perspective partially exploded, view showing the use of stiffeners and bracing at the ends of the I-beam.

DETAILED DESCRIPTION OF THE INVENTION

As seen in FIG. 1, the I-beam of the present invention in a preferred embodiment comprises a pair of elongate, parallel wooden flange members 20, of rectangular cross-section and longitudinal grain structure, interconnected by a plywood web member 22. Flange members 20 may be made, exemplarily, from nominal 2"×4" or 2"×3" structural grade lumber or a laminated wood product, and web member 22 may be made of ⅜ inch thick, three-ply plywood joined to flange members 20 by continuous adhesive joints 24.

In the preferred embodiment, web member 22 is composed of structural grade 1 plywood, arranged with the grain of a face veneer 27 perpendicular to the length of the flange members and the grain of a core veneer 29 parallel to the length of flange members 20. The web member 22 may be composed of a plurality of segments, each having a length corresponding to the width of the sheet of plywood from which it was cut, commonly 48 inches. Individual web segments are joined to one another adhesively at web segment joints 26, which may be simple butt joints, or may be of interlocking cross section.

The web member sections may be cut to various widths to form I-beams of different depth 33 as measured from top to bottom of the "I" shape. Within the strength limits of the materials used, increased depth of the I-beam provides increased I-beam strength. Using web member material having a thickness 21 of ⅜ inch, I-beam depths from 10 inches to 24 inches have been successfully used in structural applications.

Flange members 20 may be solid lengths of nominal 2"×4" or 2"×3" lumber corresponding to the entire length of the finished I-beam, or may be made up of shorter lengths of such lumber connected end-to-end by a glued scarf joint as shown at 28.

The preferred materials for flange members are Douglas Fir, Larch, Hem-Fir, or Southern Pine wood having surface moisture content less than 19%.

Preferably, the plywood should have a moisture content of from 7% to 16% at the time of web member I-beam assembly. To avoid residual stress in the web-to-flange joints the difference in moisture between web and flange materials should preferably be less than 5% at time of assembly.

As shown in FIG. 2, the glued joints 24 between flange members 20 and web member 22 comprise two elongate, tapered, parallel ribs 23 extending along opposite edges 25 of each section of web member 22, and closely fitting within corresponding grooves 42 of flange members 20. Grooves 42 are centrally located on one of the wider faces 44 of flange member 20, and extend parallel to the length of each flange member.

Referring to FIG. 3, showing a detail of joint 24 in end view, it is seen that the edge 25 of web member 22 is cut to the shape of a pair of parallel ribs 23 with an included groove 40 therebetween. A shallow cut creating a ledge 30 is made at a base plane 31 to insure that slight irregularities and variations in the thickness of plywood web material available do not cause a lack of surface contact between flange members 20 and web members 22 within the joint. A pair of long sloping outer sides 32 extend from ledge 30 toward rib edge surfaces 34 which are aligned perpendicular to the principal plane of web members 22. A pair of short sloping inner sides 36 extend toward a groove bottom surface 38 and, along with said surface 38, cooperatively define the groove 40 between ribs 23 of the edge 25 of web member 22.

Grooves 42, extending medially along a wider face 44 of flange member 20, correspond closely in profile to the surfaces of ribs 23, to provide mating contact surfaces for adhesively fastening the joints between web member 22 and flange members 20. Thus long sloping groove walls 46 correspond to long sloping outer sides 32, flat surfaces 48 correspond to rib edge surfaces 34, short sloping groove walls 50 correspond to short sloping inner sides 36, and an upper surface 52 of rib 43 corresponds to bottom surface 38 of groove 40.

A minimum width 53 of said rib edge surfaces 34 and said rib upper surface 52 is determined by the ability of the wooden material of the flange and web members to resist damage in being handled. From emperical studies it has been found that about 0.035 inch is the minimum usable width and that 0.055 inch is the preferred minimum width for use with ⅜ inch thickness plywood web material.

The depth 55 of groove 40 is preferably less than the distance 57, by which ribs 23 extend from base plane 31, defining a separation distance 58 between joint horizontal surface 38 and base plane 31. This separation distance 58 defines the oblique planes, or shear lines, 54 within web 22 wherein failure would occur if the I-beam should fail at the joint. By providing, through design, sufficient length to the shear lines 54 the web-to-flange joint is made strong enough to result in the structurally critical axis of the I-beam being located at a neutral plane 56, located in the web member 22, which is substantially parallel to and between flange members 20.

For required structural integrity, the minimum design length for each such oblique shear line 54 is proportional to the maximum web-strength required in the web-to-flange joint. More particularly, since the web member 22 itself carries part of the load stresses generated in the beam as a whole, only the stresses generated in the flange members 20, and the small portion of the web further than the oblique shear line from the neutral axis of the I-beam, must be carried by the web material along the oblique shear line 54. Accordingly, the total thickness of web material along the two sections of oblique shear line 54 can be made proportionally less than the total thickness of the web material at a point medially between the flange members.

This critical proportion, affecting the minimum design length for the oblique shear lines 54, can be mathematically determined by dividing (a) the statical moment of the cross-sectional area of the I-beam further from the neutral plane 56 than the oblique shear lines 54 by (b) the statical moment of the cross section of the complete I-beam, taking into account in the above calculation the relative strengths of the flange and web materials.

The shape of the joint cross section, having tapered ribs and corresponding grooves, provides sufficient contacting surface area for good adhesion between the ribs and grooves to ensure that the joint between the flanges and the web is not the load limiting portion of the I-beam. A rib side and groove wall slope within the range of about 5° to about 20° relative to the principal plane of the web member, with a range of from 5° to 10° being preferred, has been found satisfactory for ensuring that pressing the flanges onto the web members provides satisfactory contact.

Since the web material is plywood, laminated layers of veneer cut from a rotating solid of circular cross section, the particular weaknesses of plywood in a glued joint must be considered. This is called the rolling shear strength of the plywood. To compensate for this weakness, the surface area of an adhesive joint must be multiplied in comparison to adhesive joint between surfaces of solid wood pieces.

In the web-to-flange joint of the I-beam construction of the present invention, the area of the sloping faces of ribs and grooves forming the adhesively joined stress-carrying surfaces of the web-to-flange joint is at least 3⅓ times the area which would be exposed by a cut made perpendicularly to the plane of the web material, thus overcoming the weakness of rolling shear strength of plywood.

The two-rib design of the web portion of the joint cross section also reduces the amount of wood necessarily removed from flange 22 to receive the web edge in the joint. Thus the cross-sectional area of material removed from flange 22 approaches the minimum required to provide both sufficient shear-resistive cross section of web member material in the joint and the adhesive contact area required by rolling shear strength of the web member, and the original strength of flange members 22 is reduced only slightly by loss of material. Additionally, since all material removed is replaced by wood of the plywood web member 22, loss of flange member strength because of material removal for the joint is further minimized.

In the fabrication of wooden I-beams according to the present invention the use of graded materials for flange and web members has been found to result in predictable and consistent I-beam strengths. Each flange member is preferably visually examined and mechanically tested to determine its modulus of elasticity and bending resistance, and thereafter a resulting grade is assigned reflecting the maximum bending stress to which the particular piece should be subjected.

With more consistent material, it has been established that beams can be produced according to the present design which have a more reliable strength, thereby allowing the use of lighter weight beams for a given designed load, with no sacrifice of safety factor.

In construction of an I-beam of the invention, a properly prepared adhesive, preferably a waterproof exterior type adhesive such as one having a phenol, resorcinol, or melamine base, is applied to one or both of the surfaces to be joined. The flange grooves 42 are located in register with the web ribs 23 and the I-beam is then pressed together to provide good surface contact. In this manner ledge 30 is brought into contact with flange surface 44, and any excess adhesive is squeezed out between flange members 20 and web member 22 forming a small fillet.

The I-beam is then held together in proper dimensional relationship until the glue cures. This may be accomplished by clamping or by insertion of nails 59, as seen in FIG. 2, at intervals along the joint after assembly and pressing, and before the I-beam is removed from the pressing means.

Use of sloping sides of grooves and ribs aids assembly of the pieces of the I-beam and insures tight surface contact between flange and web members. However, since these sloping sides are formed by cutting away excess wood rather than by pressing the web margins, in contrast to the joint design employed in the Troutner patent, there is no residual stress created by swelling of the wood within the joint to split flange members 20 after the glue joint has cured. Thus more of the original strength of flange member 20 remains to absorb lateral stresses before such would cause this mode of failure in the I-beam.

Referring to FIG. 4, a typical installation of I-beams of the present invention is shown diagrammatically. The normal direction of the application of loads to the beam is shown by arrow 60 and the resulting downward elastic deformation is indicated by arrows 62. A neutral plane 56, located in the web 22, divides areas of compressive loading in the upper portion of the I-beam from areas of tension loading below the neutral plane.

FIG. 5 shows a perspective, partially exploded view of a pair of I-beams constructed according to the invention, including wooden stiffeners 64 used to provide additional support to web member 22 at the point where the I-beam is supported, and bracing used there to maintain proper orientation of the I-beams in structural use. A sill member 66 supports the ends of the joists, and for lateral bracing of the I-beams a blocking panel 68, comprised of a short section of I-beam inserted between adjacent stiffened I-beams may be used. Alternatively, metal strap bracing well-known in the art may be used.

Destructive testing of I-beams made according to the invention resulted in each case in failure in shear of the web portion at the point where the I-beam was supported or failure by buckling of the web, while the glued flange-to-web joint of the invention was never the point of failure.

The terms and expressions which have been employed in the foregoing abstract and specification are used therein as terms of description and not of limitation, and there is no intention the use of such terms and expressions of excluding equivalents of the features shown or described or portions thereof, it being recognized that the scope of the invention is defined and limited only by the claims which follow.

What is claimed is:

1. A wooden I-beam, comprising:

(a) an elongate, generally planar web member of laminated wood having a longitudinal axis, a pair of opposite edges which are generally parallel to said longitudinal axis, each one of said opposite edges having a base plane perpendicular to the plane of said web member and parallel to said one of said opposite edges and a pair of parallel ribs extending from said base plane and having sloping sides and an included groove therebetween, each said rib having a rib edge surface and said included groove having a bottom surface located closer to said rib edge surface than said base plane is located;

(b) a pair of elongate wooden flange members, said flange members being oppositely located along said opposite edges of said web member and each said flange member having a longitudinal surface comprising a pair of longitudinally-oriented parallel grooves located therein, said parallel grooves having shape and size closely corresponding to that of said ribs and included groove of said web member, and each said flange member being adhesively connected to said web member such that said ribs extend matingly into said parallel grooves with said base plane substantially aligned with said longitudinal surface, forming a joint defining a pair of oblique shear planes, each of said oblique shear planes extending through one of said ribs from the intersection of said longitudinal surface and said one of said ribs to the portion of said bottom surface of said included groove nearest to said intersection.

2. The I-beam of claim 1 wherein said sloping sides of said ribs have an included angle with respect to the plane of said web member lying within the range of 5° to 20°.

3. The I-beam of claim 1 wherein said web member comprises a core veneer having its grain oriented longitudinally of said I-beam, the entire thickness of said core veneer extending beyond said base plane into said flange member.

4. The I-beam of claim 1 wherein said ribs extend from said base plane a distance no greater than the total thickness of said web member, and the total area of said sloping rib sides is at least three and one-third times the area of the intersection of said base plane with said web member.

5. The I-beam of claim 4 wherein the total area of said pair of oblique shear planes is at least as great as the area of the intersection of said base plane with said web member multiplied by the ratio of "a" to "b"; where "a" is the statical moment, about a neutral stress plane in the web of said I-beam, of the cross-sectional area of flange and web material further from said neutral stress plane of said I-beam than a line defined by said oblique shear planes and said bottom surface of said included groove; and "b" is the statical moment of the total cross-sectional area of said I-beam about said neutral stress plane.

* * * * *